United States Patent [19]

Rusznyak

[11] Patent Number: 4,999,521

[45] Date of Patent: Mar. 12, 1991

[54] CMOS ANALOG MULTIPLYING CIRCUIT

[75] Inventor: Andreas Rusznyak, Geneva, Switzerland

[73] Assignee: Motorola, Inc., Schaumburg, Ill.

[21] Appl. No.: 272,678

[22] PCT Filed: Jan. 25, 1988

[86] PCT No.: PCT/EP88/00052

§ 371 Date: Oct. 17, 1988

§ 102(e) Date: Oct. 17, 1988

[87] PCT Pub. No.: WO88/06770

PCT Pub. Date: Sep. 7, 1988

[30] Foreign Application Priority Data

Feb. 25, 1987 [GB] United Kingdom ..... 8704458

[51] Int. Cl.[5] ..... H03B 19/00; G06G 7/00

[52] U.S. Cl. ..... 307/498; 307/359; 307/529; 307/261; 307/585

[58] Field of Search ..... 307/359, 362, 529, 494, 307/496, 497, 270, 261, 585; 330/253, 257, 260, 238, 291; 323/315, 316

[56] References Cited

U.S. PATENT DOCUMENTS

| | | | |
|---|---|---|---|
| 4,059,811 | 11/1977 | Hoffman | 330/277 |
| 4,188,588 | 2/1980 | Dingwall | 307/350 |
| 4,251,743 | 2/1981 | Hareyama | 307/496 |
| 4,706,013 | 11/1987 | Kuo | 323/316 |
| 4,710,726 | 12/1987 | Czarnul | 328/127 |
| 4,717,869 | 1/1988 | Koch et al. | 330/260 |
| 4,763,021 | 8/1988 | Stickel | 307/443 |
| 4,819,081 | 4/1989 | Volk et al. | 328/133 |

OTHER PUBLICATIONS

Abu-Zeid et al., "Field-Effect Transistor Bridge Multiplier-Divider", Electronic Letters, vol. 8, No. 24, 11/72, pp. 591-592.

Crawford et al., "FET Conductance Multipliers", Instruments and Control Systems, vol. 43, No. 9, Sep. 70, pp. 117-119.

Babanezhad, "A 20-V Four Quadrant CMOS Analog Multiplier", IEEE Solid State Circuits, vol. SC-20, No. 6, Dec. 85, pp. 1158-1168.

*Primary Examiner*—Timothy P. Callahan

*Attorney, Agent, or Firm*—Michael D. Bingham

[57] ABSTRACT

A CMOS analog multiplying circuit comprising a first transistor (1) having its current electrodes coupled between a first reference voltage line and a first node and its gate electrode coupled to a first input node having, in use, an input voltage such that said first transistor operates in its triode region, a second transistor (2) having its current electrodes coupled between said first node and an output node, said output node being coupled to a second reference voltage line, and a comparator (3) for comparing a first voltage at said first node with a second voltage at a second input node and for controlling the gate electrode of said second transistor to keep said first and second voltages substantially equal, whereby the current through said second transistor is proportional to the product of the voltages at said first and second input nodes.

8 Claims, 1 Drawing Sheet

CMOS ANALOG MULTIPLYING CIRCUIT

This invention relates to a CMOS analog multiplying circuit which provides a current output whose magnitude is proportional to the product of the values of two input variables. CMOS stands for complementary metal-oxide-semiconductor structure.

Analog multiplying circuits are, of course, well known. One such circuit is described in an article entitled "A 20-V Four-Quadrant CMOS Analog Multipler" by Joseph N. Babanezhad and Gabor C. Temes found at pages 1158–1168 of IEEE Journal of Solid-State Circuits, Vol. SC-20, No. 6, December 1985. This circuit, as do others, performs multiplication of variables which are present in the form of differential voltages and can consequently be handled by amplifiers having a differential input. Such circuits are conceived to achieve high precision multiplication of input variables whose sign can be positive or negative, i.e. they are four-quadrant multipliers. Due to their working mechanisms, the input variables have to be voltages whose DC component is of a predetermined value in order to bias correctly the differential input amplifiers. This fact and the fact that input variables have to be present in the form of differential voltages constitute a drawback in application. Also, to achieve four-quadrant multiplication with high precision, their complexity is high which results in relatively high manufacturing costs.

It is thus desirable to produce a one-quadrant multiplier which does not necessarily achieve high precision, which is of low complexity and consequently has low manufacturing costs.

Accordingly, the invention provides a CMOS analog multiplying circuit comprising a first transistor having its current electrodes coupled between a first reference voltage line and a first node and its gate electrode coupled to a first input node having, in use, an input voltage such that said first transistor operates in its triode region, a second transistor having its current electrodes coupled between said first node and an output node said output node being coupled to a second reference voltage line, and a comparator for comparing a first voltage at said first node with a second voltage at a second input node and for controlling the gate electrode of said second transistor to keep said first and second voltages substantially equal, whereby the current through said second transistor is proportional to the product of the voltages at said first input and second input nodes.

In one embodiment of the invention, the comparator comprises a differential amplifier having its inverting input coupled to said first node and its non-inverting input coupled to said second input node and whose output is coupled to the gate of said second transistor.

In a second embodiment of the invention, the comparator comprises a long-tailed pair of transistors, the node formed by their source electrodes being coupled to a constant current source, the gate of the first of the transistors forming said long-tailed pair being coupled to said second input node, the gate of the second transistor forming said long-tailed pair being coupled to said first node, the drain of said first transistor of said long-tailed pair being coupled to the input of a current mirror whose output is coupled to the drain of the second transistor of said long-tailed pair, the drain of said second transistor of said long-tailed pair constituting the output of the comparator and being coupled to the gate electrode of said second transistor.

In a preferred embodiment of the invention, said output node is coupled to the second reference line via a current mirror.

It will be appreciated that the voltages applied to the input nodes may constitute the input variables or that one or both of them may result from an appropriate conversion of current to voltage if the variables to be multiplied are currents.

The invention will now be more fully described by way of examples with reference to the drawings of which:

Figure 1:
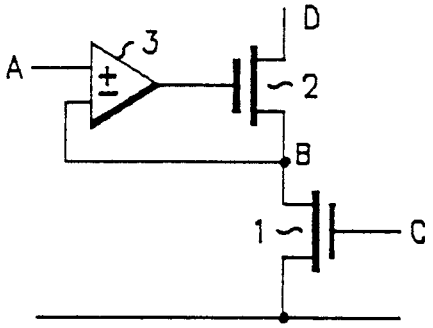
FIG. 1 shows a simplified version of a CMOS analog multiplying circuit according to the invention.

Thus, there is shown in FIG. 1 a simplified version of a CMOS analog multiplying circuit according to the invention. This circuit comprises a first transistor 1 whose source electrode is coupled to a first voltage reference line and whose drain electrode is coupled to the source electrode of a second transistor 2 via node B, the drain electrode of the second transistor 2 being coupled to an output node D. The gate electrode of the transistor 1 is coupled to a first input node C and the gate electrode of the transistor 2 is coupled to the output of a comparator 3. Node B is coupled to the inverting input of the comparator whereas node A is coupled to its non-inverting input.

Figure 3:
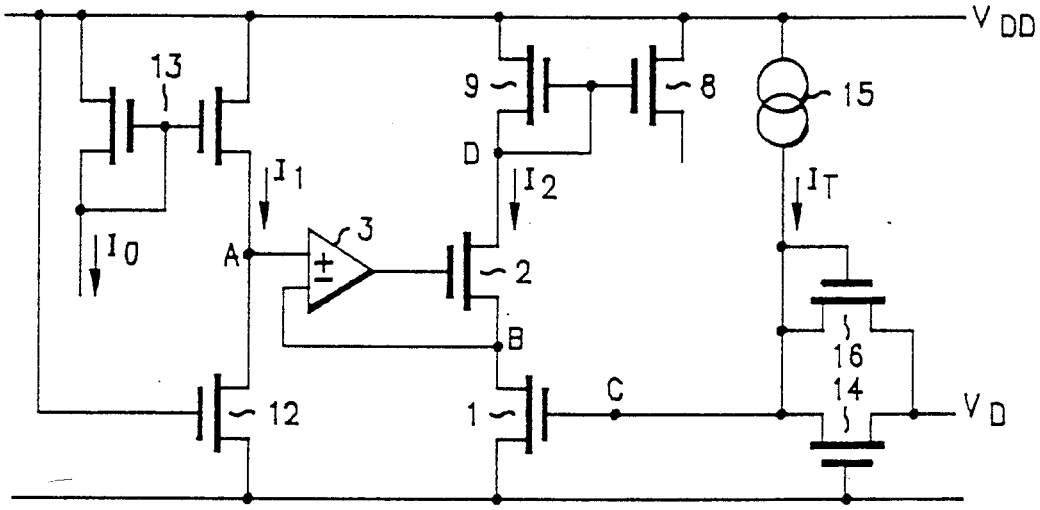
FIG. 3 shows a variation of the circuit of FIG. 1 used to produce an output current having a value between approximately zero and a predetermined value.

The comparator 3 ensures that the voltage at node A and that at node B are kept substantially equal by controlling the gate of transistor 2. Due to the fact that transistor 1 operates in triode region, for an input voltage $v_c$ proportional to the current through transistor 1 will be provided that the voltage $V_C$ is noticeably higher than the threshold voltage of transistor 1. The current $I_D$ through transistor 2 can then be fed to other parts of the circuit by means of a current mirror formed by transistors 8 and 9 as shown in FIG. 3.

Figure 2:
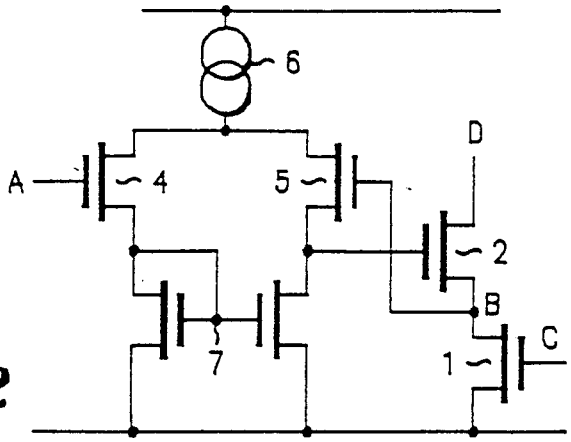
FIG. 2 shows a preferred embodiment of the comparator used in the invention.

If only relatively low precision has to be realised the circuit shown in FIG. 2 can be used as comparator 3. This circuit comprises a pair of long-tailed transistors 4 and 5 whose gates are coupled to node B for transistor 5 and to node A for transistor 4. The common source of these transistors is supplied by constant current source 6. The drain of transistor 4 is coupled to the input of a current mirror 7 whose output representing the output of the comparator is coupled to the drain of transistor 5 and to the gate of transistor 2.

The circuit of FIG. 1 may be used in a number of applications. One such application is shown in FIG. 3 where the output current of the current mirror 8, 9 supplied by the current through transistor 2 can be adjusted to have any value between zero and a value predetermined by the current $I_0$. In this arrangement, the input current $I_0$ is mirrored by a current mirror 13 to provide current $I_1$ through transistor 12. The voltage at node A will be proportional to the current $I_0$ when transistor 12 is biased by a supply voltage on the second reference line whose value is noticeably higher than the threshold voltage of transistor 12 so that it operates in its triode region. The input voltage $V_0$ is supplied to node C via a transistor 14 acting as a transmission gate element. The transistor 14 is coupled in parallel with a further transistor 16 connected as a diode and supplied by a current $I_T$. This configuration allows the voltage $V_0$ whose value varies between 0 and that of the supply voltage $V_{DD}$ applied to the second reference line to control the value of the output current at node D in the range between approximately 0 and a value determined by $I_0$ regardless of the threshold voltage of transistor 1.

Figure 4:
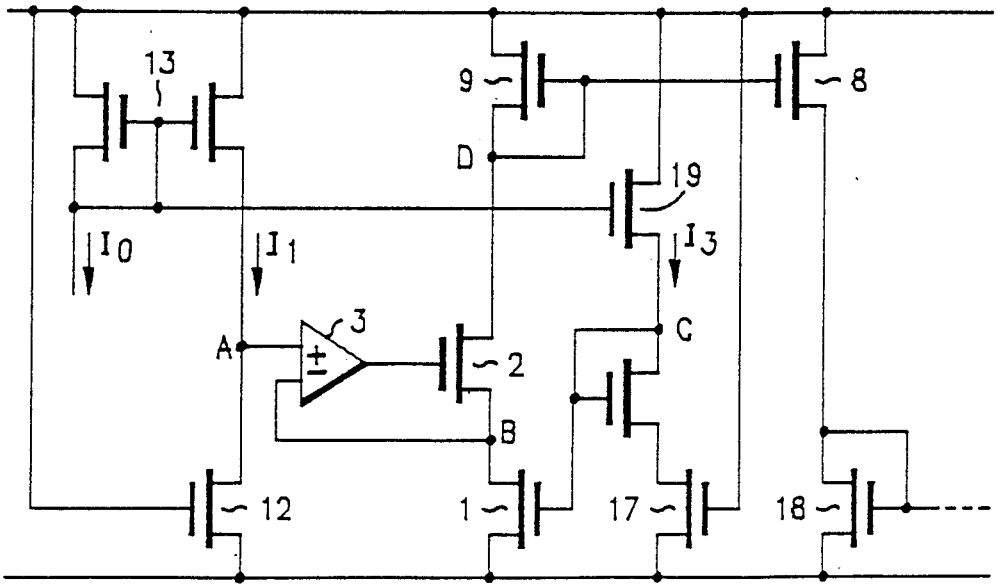
FIG. 4 shows a further variation of the circuit of FIG. 1 for providing an output current which compensates for variations in the transconductance of further transistors.

A second application of the circuit of FIG. 1 is shown in FIG. 4. In this case the circuit is used to control the transconductance of further transistors in the circuit by supplying them with a current whose value varies with process and temperature variations.

The transconductance $g_m$ of a transistor whose current is described by $$I=K(V-V_T)^2$$

can be expressed as $$g_m = \sqrt[2]{I.K}$$

where K is a constant of the transistor depending on its geometry, on process parameters and on the temperature. V is the voltage on its gate electrode and $V_T$ is its threshold voltage.

Changes of $g_m$ due to process or temperature fluctuations can be compensated for by appropriate control of current I. A constant $g_m$ can be achieved if current I varies inversely to K. Such a current I is generated by the circuit shown in FIG. 4.

In this circuit the input current $I_0$ is constant or very nearly so. Currents $I_1$ and $I_3$ are provided by current mirrors 13 and 19 so that they are proportional to current $I_0$. The voltage $V_A$ at node A is given by $$V_A \approx \frac{I_1}{2K_{12}(V_{DD}-V_T)}$$

Thus $V_A$ is in good approximation proportional to $1/K_{12}$. In the same way $V_C$ is given by $$V_C \approx \frac{I_3}{2K_{17}(V_{DD}-V_T)} + V_T$$

Now, the value of the control current $I_2$ is given by $$I_2 = K_1\,[2(V_C - V_T) - V_A]\,V_A$$

For $$\frac{I_1}{K_{12}} << \frac{2I_3}{K_{17}}$$

so that $$I_2 \approx \left[\frac{I_1}{2(V_{DD}-V_T)}\right]^2 \frac{2K_1}{K_{12}\,K_{17}}$$

For transconductance $g_{m18}$ of transistor 18 one can write $$g_{m18} = \sqrt[2]{I_2K_{18}} \approx \frac{I_1}{V_{DD}-V_T}\sqrt{\frac{K_1\,K_{18}}{K_{12}K_{17}}}$$

For $V_{DD} >> V_T$ we thus have that $$g_{m18} \approx \frac{I_o}{V_{DD}}\sqrt{\frac{K_1\,K_{18}}{K_{12}\,K_{17}}}$$

Thus the transconductance of a transistor supplied with a current proportional to $I_2$ is then proportional to the square root of its own K-value multiplied by $$\sqrt{\frac{K_1}{K_{12}K_{17}}},$$

i.e. independent or very nearly independent of process and or temperature variations.

The circuit thus mirrors current $I_2$ by means of transistors 8 and 9 and passes this mirrored current to transistor 18 or to other transistors not shown whose transconductance will now be held constant.

It has to be pointed out that the current $I_2$ which controls the transconductance of a transistor of type n (transistor 18) depends exclusively on the characteristics of transistors of the same conductivity type. For this reason the control does not depend on the ratio of threshold voltages of the n and p type transistors.

Although the above description of the invention only describes how the multiplication of two parameters can be achieved by using n-channel MOS transistors which operate in their triode regions, it is obvious that the same features can be realised converting the described circuits into their complementary ones, e.g. that the transistors n will be replaced by p-type transistors, the p-type ones by n-types inverting at the same time also the polarity of voltages.

I claim:

1. A CMOS analog multiplying circuit comprising a first transistor having its current electrodes coupled between a first reference voltage line and a first node and its gate electrode coupled to a first input node having, in use, a variable input voltage such that the first transistor operates in its triode region, a second transistor having its current electrodes coupled between said first node and an output node, and a comparator for comparing a first voltage at said first node with a second variable voltage at a second input node and for controlling the gate electrode of said second transistor to keep said first and second voltages substantially equal, whereby the current through said second transistor is proportional to the product of the voltages at said first input and second input nodes.

2. A CMOS analog multiplying circuit according to claim 1 wherein the comparator comprises a differential amplifier having its inverting input coupled to said first node, and its non-inverting input coupled to said second input node and whose output is coupled to the gate of said second transistor.

3. A CMOS analog multiplying circuit according to claim 1 wherein said comparator comprises a long-tailed pair of transistors, the node formed by their source electrodes being coupled to a constant current source, the gate of the first of the transistors forming said long-tailed pair being coupled to said second input node, the gate of the second transistor forming said long-tailed pair being coupled to said first node, the drain of said first transistor of said long-tailed pair being coupled to the input of a current mirror whose output is coupled to the drain of the second transistor of said long-tailed pair, the drain of said second transistor of said long-tailed pair constituting the output of the comparator and being coupled to the gate electrode of said second transistor.

4. A CMOS analog multiplying circuit according to claim 1 wherein said output node is coupled to a second reference voltage line via a current mirror.

5. A CMOS analog multiplying circuit according to claim 1 wherein at least one of said input nodes is coupled to the output node of a current source and is coupled, directly or indirectly, to the drain of a third transistor whose source is coupled to said first reference voltage line and whose gate is coupled to a second reference voltage line on which, in use, the voltage is such that said third transistor operates in its triode region.

6. A CMOS analog multiplying circuit according to claim 5 wherein said at least one input node is coupled directly to the drain of said third transistor.

7. A CMOS analog multiplying circuit according to claim 5 wherein said at least one input node is coupled to the gate and to the drain of a further transistor whose source is coupled to the drain of said third transistor.

8. A CMOS analog multiplying circuit according to claim 1 wherein at least one of said input nodes is connected to an auxiliary input node for supplying an input voltage via an auxiliary transistor whose drain and gate are connected to said at least one input node and are supplied by a further current source, and said at least one input node being further coupled to said auxiliary input node via a complementary transistor forming an element of a transmission gate.

* * * * *